US007247077B1

(12) United States Patent
Arias

(10) Patent No.: US 7,247,077 B1
(45) **Date of Patent: *Jul. 24, 2007**

(54) AQUATIC TOYS

(75) Inventor: David A. Arias, Virginia Beach, VA (US)

(73) Assignee: Swimways Corp., Virginia Beach, VA (US)

( * ) Notice: Subject to any disclaimer, the term of this patent is extended or adjusted under 35 U.S.C. 154(b) by 247 days.

This patent is subject to a terminal disclaimer.

(21) Appl. No.: 10/817,293

(22) Filed: Apr. 2, 2004

Related U.S. Application Data

(63) Continuation-in-part of application No. 10/776,981, filed on Feb. 11, 2004, now Pat. No. 6,923,706.

(51) Int. Cl.
*A63H 23/00* (2006.01)

(52) U.S. Cl. ..... 446/153; 446/156; 273/350; 273/458

(58) Field of Classification Search ..... 446/153, 446/166, 167, 156, 129; 482/55, 66, 118; 472/128, 129, 133; 434/254; 273/350, 440, 273/342, 460, 447, 398, 458; 441/1, 80
See application file for complete search history.

(56) References Cited

U.S. PATENT DOCUMENTS

| | | | | | |
|---|---|---|---|---|---|
| 954,544 | A | | 4/1910 | Sanford | |
| 1,639,607 | A | * | 8/1927 | Henry | 472/129 |
| 2,124,062 | A | * | 7/1938 | Grant et al. | 441/40 |
| 2,562,080 | A | * | 7/1951 | Barnes | 441/131 |
| 2,932,916 | A | * | 4/1960 | Strickland | 446/156 |
| 3,014,723 | A | * | 12/1961 | Butler | 273/350 |
| 3,095,197 | A | * | 6/1963 | Weitzman | 273/350 |
| 3,161,897 | A | * | 12/1964 | Hill | 441/130 |
| 3,323,795 | A | * | 6/1967 | Quello | 472/128 |
| 3,332,166 | A | * | 7/1967 | Alexander | 446/431 |
| 3,656,749 | A | * | 4/1972 | Reyes | 473/485 |
| 3,895,801 | A | * | 7/1975 | Baird | 273/350 |
| 3,897,647 | A | | 8/1975 | Black | |
| 4,268,989 | A | * | 5/1981 | Wickham | 446/153 |
| 4,467,555 | A | * | 8/1984 | Terzian et al. | 446/158 |
| 4,515,572 | A | | 5/1985 | Emms | |
| 4,707,869 | A | * | 11/1987 | Ray | 4/505 |
| 4,744,565 | A | * | 5/1988 | Newberger | 273/342 |
| 5,096,453 | A | | 3/1992 | Van Meter | |
| 5,141,440 | A | * | 8/1992 | Wallingford | 434/254 |
| 5,141,441 | A | * | 8/1992 | Wallingford | 434/254 |

(Continued)

FOREIGN PATENT DOCUMENTS

| | | | |
|---|---|---|---|
| GB | 0163866 | * | 3/1920 |

OTHER PUBLICATIONS

Copending U.S. Appl. No. 10/776,981, dated Feb. 11, 2004, David A. Arias.

*Primary Examiner*—Bena Miller

(57) ABSTRACT

An aquatic toy that is capable of maintaining a desired form and position in water, which includes a fabric portion, at least one hollow opening formed in the fabric portion, a frame pocket formed substantially around a perimeter of the hollow opening, and a frame member, wherein the frame member is at least partially contained within the frame pocket, and wherein the frame member provides at least partial form to a perimeter of the hollow opening. The aquatic toy may also include at least one buoyancy element and at least one weight element.

14 Claims, 8 Drawing Sheets

U.S. PATENT DOCUMENTS 5,219,307 A * 6/1993 Morrison ..... 441/38
5,329,714 A 7/1994 Lee
5,433,637 A * 7/1995 Graves ..... 441/80
5,538,454 A 7/1996 Kessler
5,603,176 A 2/1997 Eddins et al.
5,722,871 A * 3/1998 Zamir ..... 446/153
5,845,697 A 12/1998 Zheng
D425,357 S 5/2000 Waring
6,088,953 A 7/2000 Morgan
D429,310 S 8/2000 Diliberti
6,170,100 B1 1/2001 Le Gette et al.
6,332,822 B2 12/2001 Greenberg et al.
6,343,391 B1 2/2002 Le Gette et al.
6,478,038 B1 11/2002 Le Gette et al.
6,485,344 B2 11/2002 Arias
6,511,074 B1 1/2003 Fireman
6,519,793 B2 2/2003 Le Gette et al.
6,575,185 B2 6/2003 Zheng
6,595,227 B2 7/2003 Le Gette et al.
6,641,787 B1 * 11/2003 Siggins et al. ..... 422/264
6,699,535 B2 3/2004 Boschert
6,840,830 B1 * 1/2005 Harlan ..... 441/35
2001/0024924 A1 * 9/2001 Ueno et al. ..... 446/153

* cited by examiner

AQUATIC TOYS

CROSS-REFERENCE TO RELATED APPLICATIONS

This application is a Continuation-In-Part of U.S. patent application Ser. No. 10/776,981, entitled "Aquatic Toys," filed Feb. 11, 2004, now U.S. patent application Ser. No. 6,923,706, the disclosure of which is incorporated herein by reference.

BACKGROUND OF THE INVENTION

Field of the Invention

This invention relates generally to aquatic toys.

SUMMARY OF THE INVENTION

The present invention relates to an aquatic toy that is generally weighted and/or buoyed and includes a frame member that is capable of providing at least some rigidity and structure to at least a portion of the aquatic toy.

The frame member is at least partially covered by and/or attached to a fabric portion. In various exemplary embodiments, the fabric portion is in the shape of an object, plant, animal, or other character. The frame member is at least partially surrounded by the fabric portion such that a hollow opening is formed in the fabric portion by the frame member.

The aquatic toy is generally weighted and/or buoyed such that when placed in a body of water, such as, for example, a swimming pool, the aquatic toy is capable of maintaining a desired form and position in the water. In various exemplary embodiments, the aquatic toy is generally weighted and/or buoyed such that it is capable of maintaining a desired vertical or horizontal position in the water. In this manner, a swimmer may, in various exemplary embodiments, swim through the hollow opening formed by the frame member.

In various exemplary embodiments, weights and/or buoys are positioned in or on certain areas of the fabric portion such that, when placed in a body of water, the fabric portion of the aquatic toy is capable of being maintained in a relatively opened position so that the object, plant, animal, or other character formed by the fabric portion is visible.

Depending upon the degree of weight and/or buoyancy provided to various portions of the aquatic toy, certain portions of the aquatic toy may have a relatively negative buoyancy while other portions of the aquatic toy may have a relatively positive buoyancy. If the aquatic toy has a relatively negative overall buoyancy, the aquatic toy will sink to the bottom of, for example, a swimming pool, until at least a portion of the aquatic toy is in contact with the bottom of the pool.

If the aquatic toy has a relatively positive overall buoyancy, the aquatic toy will float towards the top surface of the water in the swimming pool, until at least a portion of the aquatic toy reaches the top surface of the water.

If the aquatic toy has a relatively neutral overall buoyancy, the aquatic toy will float at a given depth in the water in the swimming pool.

A certain amount of rigidity and structure may be provided to the aquatic toy by means of the frame member. In various exemplary embodiments, the frame member may be removed from the aquatic toy, such that the fabric portion of the aquatic toy may be folded or collapsed when not in use.

When the aquatic toy is to be used, the frame member may be reattached or inserted into the aquatic toy to, once again, provide some rigidity and structure to the aquatic toy.

Accordingly, this invention provides an aquatic toy, which, when placed in a body of water, is capable of maintaining a desired form and position in the water.

This invention separately provides an aquatic toy, which may be easily folded or collapsed when not in use.

This invention separately provides an aquatic toy, which is simple and cost effective.

These and other features and advantages of this invention are described in or are apparent from the following detailed description of the exemplary embodiments.

BRIEF DESCRIPTION OF THE DRAWINGS

The exemplary embodiments of this invention will be described in detail, with reference to the following figures, wherein like reference numerals refer to like parts throughout the several views, and wherein.

DETAILED DESCRIPTION

For simplicity and clarification, the design factors, construction, and layout of the aquatic toys according to this invention are explained with reference to various exemplary embodiments of an aquatic toy according to this invention. The basic explanation of the operation of the aquatic toy is applicable for the understanding and design of the constituent components employed in the aquatic toys of this invention.

It should be appreciated that, for simplicity and clarification, the embodiments of this invention will be described with reference to several exemplary embodiments of the aquatic toy, wherein the fabric portion is in the shape of an animal or seaweed. However, it should be appreciated that the fabric portion of the aquatic toys of this invention may take the shape of any object, plant, animal, or other character.

It should also be appreciated that, for simplicity and clarification, the embodiments of this invention will be shown and/or described with reference to the aquatic toys having a frame member and a hollow opening, each having a generally circular shape. However, the generally circular geometry of the frame member and the hollow opening is intended to be illustrative, not limiting. Thus, it should be understood that the overall geometry of the frame member and/or the hollow opening may comprise any overall geometry, including, for example, a generally square, rectangle, triangular, pentangular, circular, oval, elliptical, star, or other shape. Furthermore, the overall geometry of the frame member may be substantially the same as the overall geometry of the hollow opening or may differ from that of the hollow opening.

Figure 1:
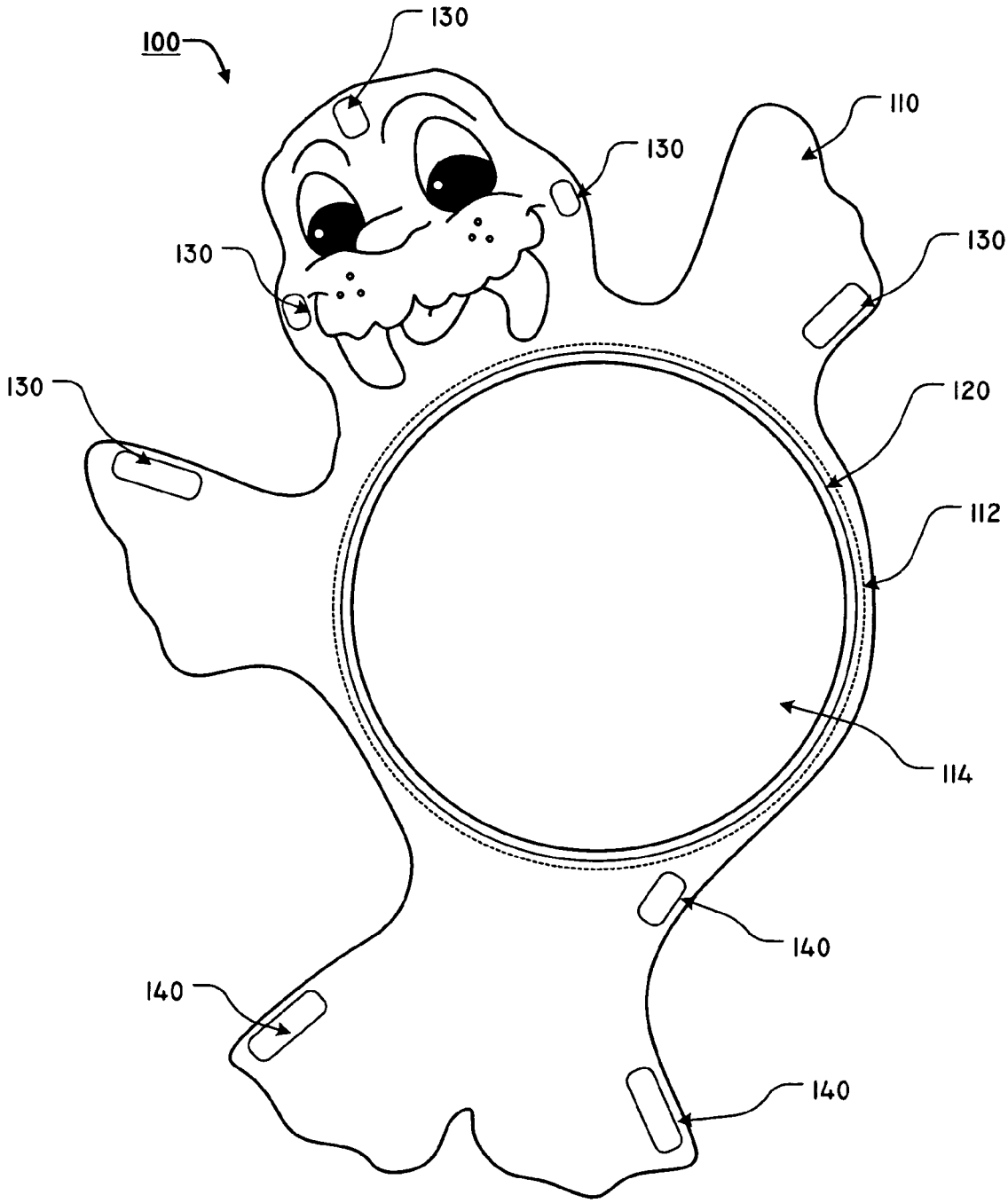
FIG. 1 shows a front view of a first exemplary embodiment of an aquatic toy in a fully expanded or open configuration according to this invention.

FIG. 1 shows a front view of a first exemplary embodiment of an aquatic toy 100 according to this invention. As shown in FIG. 1, the aquatic toy 100 is in a fully expanded or open configuration and includes at least some of a fabric portion 110, at least one frame pocket 112, a frame member 120, at least one optional buoyancy element 130, and at least one optional weight element 140.

As shown in FIG. 1, the fabric portion 110 is in the general shape of a walrus. However, it should be appreciated that the fabric portion of the aquatic toys of this invention may be in the shape of any object, plant, animal, or other character.

In various exemplary embodiments, the fabric portion 110 is made of a lightweight fabric or other material and may include woven fabrics, sheet fabrics, films, nylon, spandex, vinyl, Polyvinyl Chloride (PVC), neoprene, or the like. Additionally, the fabric portion 110 may be made of any flexible and/or elastic material and may stretch. Alternatively, the fabric portion 110 may be formed from multiple materials. The fabric may be water-resistant and durable enough to withstand the wear and tear associated with an aquatic toy that is appropriate for outdoor and/or pool use. In various exemplary embodiments, the fabric portion 110 may include a cushion material.

It should be appreciated that the terms fabric and material are to be given their broadest meanings and that the particular fabric or material used to form the fabric portion 110 is a design choice based on the desired appearance, wearability, buoyancy, and/or functionality of the aquatic toy 100.

In various exemplary embodiments, the fabric portion 110 may have a relatively negative, neutral, or positive buoyancy, such that the fabric portion 110 may provide at least some negative, neutral, or positive buoyancy to the aquatic toy 100 or at least a portion of the aquatic toy 100.

A hollow opening 114 is formed in the fabric portion 110 of the aquatic toy 100. The size, position, and overall geometry of the hollow opening 114 may vary and is a design choice based on the desired appearance and/or functionality of the aquatic toy 100. However, in various exemplary embodiments, the hollow opening 114 may be large enough that an average youngster can swim through the hollow opening 114.

Figure 8:
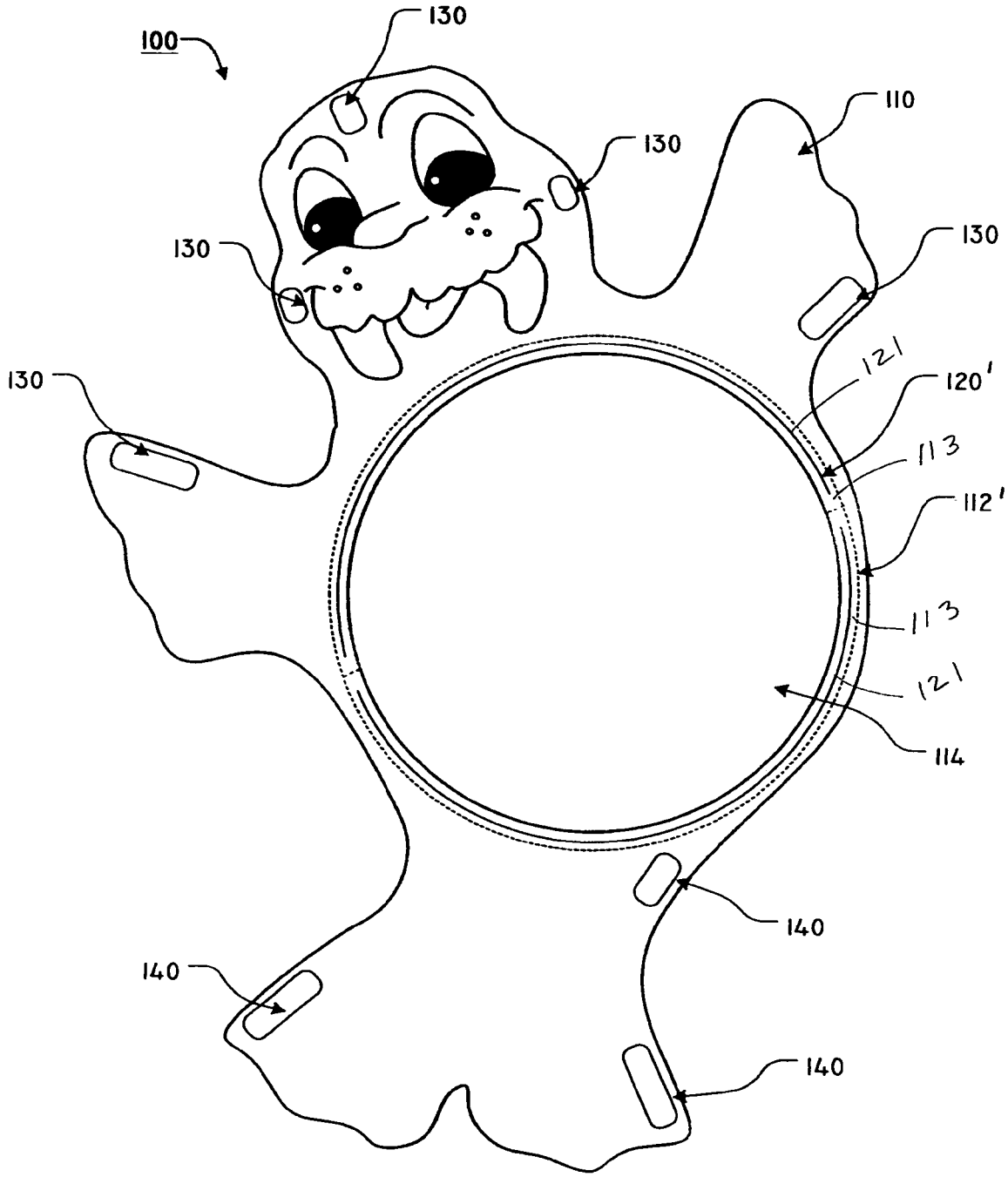
FIG. 8 illustrates the embodiment of FIG. 1 having multiple frame pockets and multiple frame segments.

At least one frame pocket 112 is formed substantially around a perimeter of the hollow opening 114, such that a frame member 120 may be at least partially held or contained within the frame pocket 112. In various embodiments, a frame pocket 112' is comprised of multiple frame pockets 113 (see FIG. 8), which are formed substantially around a perimeter of the hollow opening 114. In these embodiments, a frame member 120' is comprised of multiple corresponding frame member segments 121 (see FIG. 8), each of which may be at least partially held or contained within at least one of the multiple frame pockets.

In various exemplary embodiments, the frame pocket 112 may be constructed such that it may at least partially enclose the frame member 120 by means of a frame pocket fastening means (not shown). The frame pocket fastening means, if included, allow the frame pocket 112 to be maintained in a closed position around at least a portion of the frame member 120. In various exemplary embodiments, the frame pocket fastening means comprises releasable fasteners such as male/female snap-release buckles, Velcro or other hook-and-loop fasteners, a ziplock fastening device, a zipper, buttons, snaps, or other fastening or closure means known by those skilled in the art.

The frame member 120 may be merely held or retained within the frame pocket 112 without being connected thereto. Alternatively, the frame member 120 may be mechanically fastened, joined, stitched, fused, or glued within the frame pocket 112, such that the frame member 120 is retained in a specific position relative to the frame pocket 112 or the aquatic toy 100.

The frame member 120 provides at least partial rigidity or structure to at least a portion of the perimeter of the hollow opening 114 and holds the perimeter of the hollow opening 114 in an expanded or open configuration and provides form to the hollow opening 114.

In various exemplary embodiments, the frame member 120 may comprise a single unitary element. Alternatively, the frame member 120 may comprise at least one strip or segment of frame member material connected to form a continuous loop, as further shown and described with reference to FIG. 6.

The frame member 120 may be formed from, for example, metal, fiberglass, plastic, PVC, nylon, or the like, and may be rigid or flexible. The frame member 120 may be coated with a layer of corrosion resistant material, such as, for example, Polyvinyl Chloride, to protect the frame member 120 from corrosion and rust. In various exemplary embodiments, the frame member 120 may be formed from a waterproof or corrosion resistant material or from a material that has been treated such that it is at least partially resistant to water damage or corrosion.

As further shown in FIG. 1, the aquatic toy 100 includes at least one optional buoyancy element 130 and at least one optional weight element 140. Each optional buoyancy element 130 may be comprised of foam, Styrofoam® or any other multicellular expanded synthetic resin, cork, an inflated or inflatable pocket or bladder, plastic, rubber, wood, or an equivalent, or any other known or later developed material or system capable of providing a determined level of relatively buoyancy to the aquatic toy 100.

Each optional weight element 140 may be comprised of metal, a weighted or weightable pocket or bladder, plastic, rubber, wood, or an equivalent, or any other known or later developed material or system capable of providing a determined level of relatively weight to the aquatic toy 100.

Each optional buoyancy element 130 is placed such that a particular region or portion of the aquatic toy 100 and/or the fabric portion 110 has a determined relatively buoyancy, while each optional weight element 140 is placed such that a particular region or portion of the aquatic toy 100 and/or the fabric portion 110 has a determined relatively weight. In this manner, certain portions of the aquatic toy 100 and/or certain portions of the fabric portion 110 are generally buoyed and/or weighted such that when the aquatic toy 100 is placed in a body of water, such as, for example, a swimming pool, the aquatic toy 100 is capable of maintaining a desired form and position in the water.

In various exemplary embodiments, each optional buoyancy element 130 and each optional weight element 140 is placed or positioned in or on certain areas of the fabric portion 110 such that, when the aquatic toy 100 is placed in a body of water, the fabric portion 110 is capable of being maintained in a relatively opened position so that the object, plant, animal, or other character formed by the fabric portion 110 is visible.

In various exemplary embodiments, the optional buoyancy element(s) 130 and the optional weight element(s) 140 are not used and the buoyancy and/or weight is provided to the aquatic toy 100 and/or certain portions of the fabric portion 110 by the frame member 120 and/or the material used in certain areas of the fabric portion 110.

The frame member 120 may provide sufficient weight and/or buoyancy to maintain the aquatic toy 100 in the desired position in water. In these embodiments, various portions of the frame member 120 may be weighted and/or buoyed, either inherently or intrinsically, or by various buoyancy and/or weight elements. Alternatively, wherein the frame member 120 is comprised of multiple corresponding frame member segments (not shown), each frame member segment may be weighted and/or buoyant, such that, when positioned within at least one of the multiple frame pockets (not shown), each frame member segment (not shown) provides sufficient weight and/or buoyancy to maintain the aquatic toy 100 in the desired position in water.

The material used to form the fabric portion 110 may provide sufficient weight and/or buoyancy to maintain the aquatic toy 100 in the desired form and position in water. In these embodiments, the fabric portion 110 may be formed of a naturally weighted or buoyant material or various portions of the fabric portion 110 may be formed of a naturally weighted or buoyant material.

It should be appreciated that any combination of optional buoyancy elements 130, optional weight elements 140, a weighted and/or buoyed frame member 120, weighted and/or buoyed frame member segments (not shown), and weighty and/or buoyant fabric portion(s) 110 may be used.

As illustrated in FIG. 1, the aquatic toy 100 is in the general shape of a walrus and includes exemplary buoyancy elements 130 and exemplary weight elements 140 positioned such that the fabric portion 110 is maintained in a relatively open position and the aquatic toy 100 may be maintained in a relatively vertical position in water.

Figure 2:
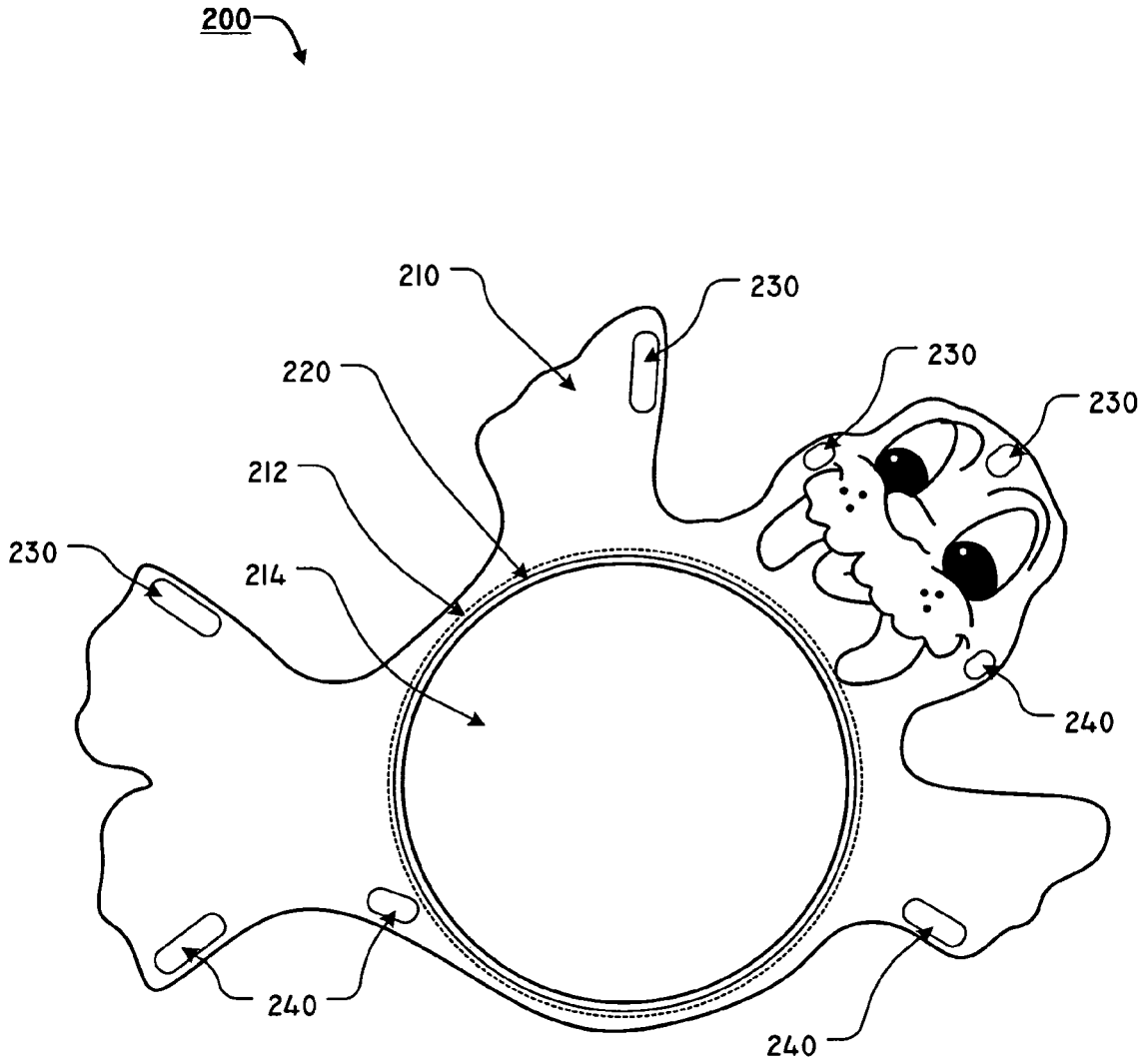
FIG. 2 shows a front view of the second exemplary embodiment of the aquatic toy in a fully expanded or open configuration according to this invention.

FIG. 2 shows a front view of a second exemplary embodiment of the aquatic toy in a fully expanded or open configuration according to this invention. As shown in FIG. 2, the aquatic toy 200 includes at least some of a fabric portion 210, a frame pocket 212, a hollow opening 214, a frame member 220, at least one optional buoyancy element 230, and at least one optional weight element 240.

It should be understood that each of these elements corresponds to and operates similarly to the fabric portion 110, the frame pocket 112, the hollow opening 114, the frame member 120, the at least one optional buoyancy element 130, and the at least one optional weight element 140, as described above with reference to FIG. 1. However, as shown in FIG. 2, the aquatic toy 200 includes exemplary buoyancy elements 230 and exemplary weight elements 240 positioned such that the fabric portion 210 is maintained in a relatively open position and the aquatic toy 200 may be maintained in a relatively horizontal position in water.

Figure 3:
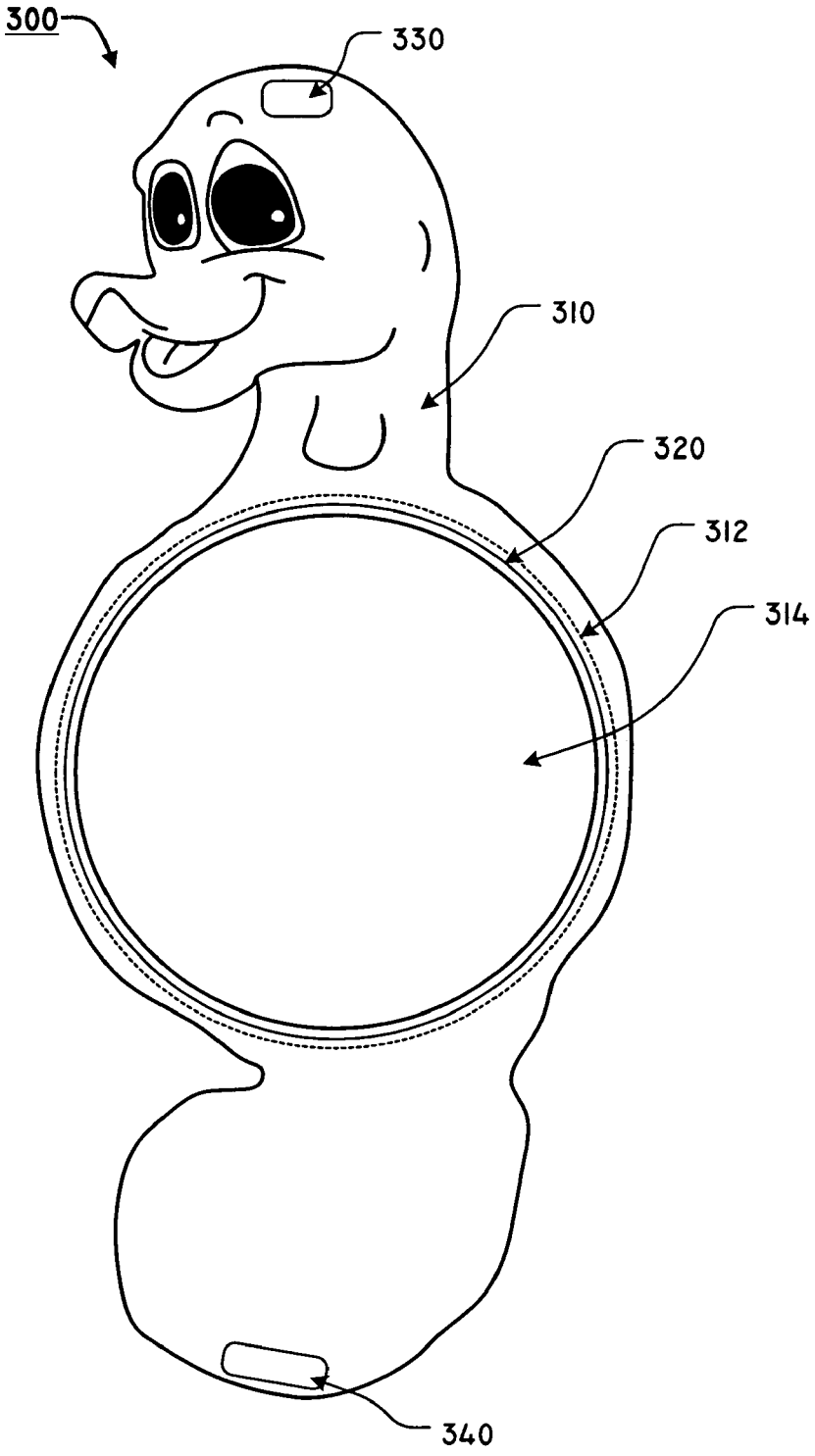
FIG. 3 shows a front view of the third exemplary embodiment of an aquatic toy in a fully expanded or open configuration according to this invention.

FIG. 3 shows a front view of the third exemplary embodiment of an aquatic toy in a fully expanded or open configuration according to this invention. As shown in FIG. 3, the aquatic toy 300 includes at least some of a fabric portion 310, a frame pocket 312, a hollow opening 314, a frame member 320, at least one optional buoyancy element 330, and at least one optional weight element 340.

It should be understood that each of these elements corresponds to and operates similarly to the fabric portion 110, the frame pocket 112, the hollow opening 114, the frame member 120, the at least one optional buoyancy element 130, and the at least one optional weight element 140, as described above with reference to FIG. 1. As shown in FIG. 3, the aquatic toy 300 includes an exemplary buoyancy element 330 and an exemplary weight element 340 positioned such that the fabric portion 310 is maintained in a relatively open position and the aquatic toy 300 may be maintained in a relatively vertical position in water.

Figure 4:
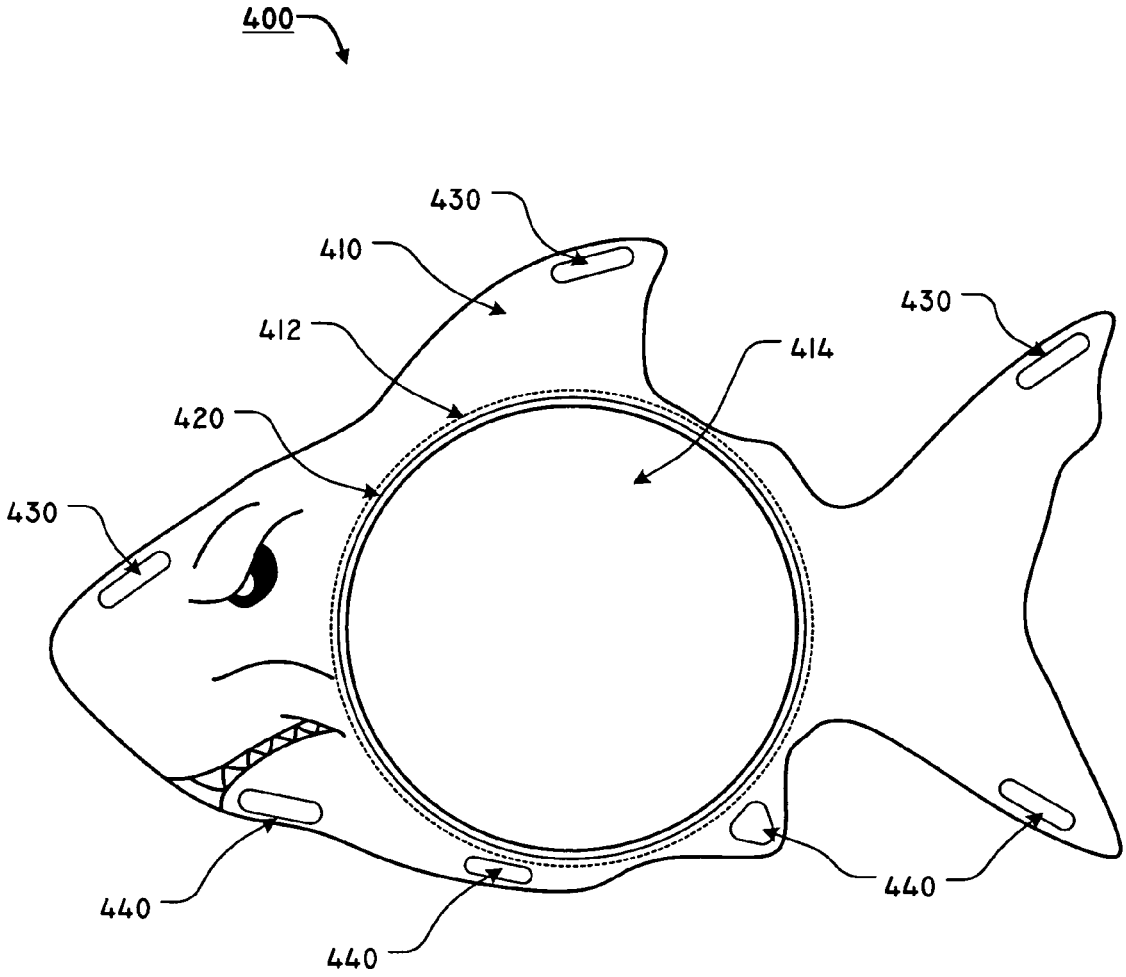
FIG. 4 shows a front view of the fourth exemplary embodiment of an aquatic toy in a fully expanded or open configuration according to this invention.

FIG. 4 shows a front view of the fourth exemplary embodiment of an aquatic toy in a fully expanded or open configuration according to this invention. As shown in FIG. 4, the aquatic toy 400 includes at least some of a fabric portion 410, a frame pocket 412, a hollow opening 414, a frame member 420, at least one optional buoyancy element 430, and at least one optional weight element 440.

It should be understood that each of these elements corresponds to and operates similarly to the fabric portion 110, the frame pocket 112, the hollow opening 114, the frame member 120, the at least one optional buoyancy element 130, and the at least one optional weight element 140, as described above with reference to FIG. 1. As shown in FIG. 4, the aquatic toy 400 is in the general shape of a shark and includes exemplary buoyancy elements 430 and exemplary weight elements 440 positioned such that the fabric portion 410 is maintained in a relatively open position and the aquatic toy 400 may be maintained in a relatively horizontal position in water.

Figure 5:
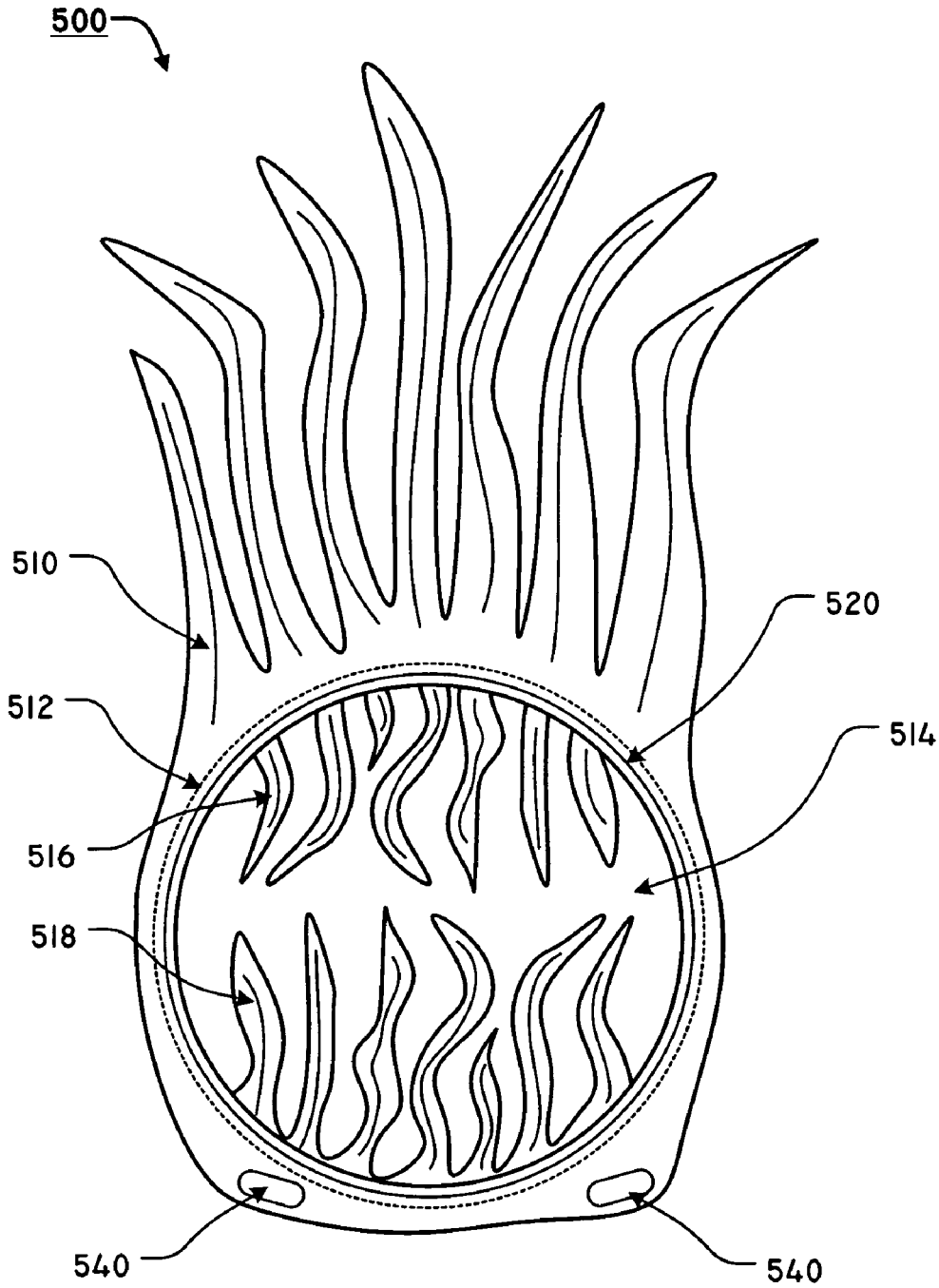
FIG. 5 shows a front view of the fifth exemplary embodiment of an aquatic toy in a fully expanded or open configuration according to this invention.

FIG. 5 shows a front view of the fifth exemplary embodiment of an aquatic toy in a fully expanded or open configuration according to this invention. As shown in FIG. 5, the aquatic toy 500 includes at least some of a fabric portion 510, a frame pocket 512, a hollow opening 514, a frame member 520, and at least one optional weight element 540.

It should be understood that each of these elements corresponds to and operates similarly to the fabric portion 110, the frame pocket 112, the hollow opening 114, the frame member 120, the at least one optional buoyancy element 130, and the at least one optional weight element 140, as described above with reference to FIG. 1. It should also be understood that the aquatic toy 500 may include at least one optional buoyancy element 530 (not shown).

However, as shown in FIG. 5, the aquatic toy 500 is in the general shape of a mass of seaweed and includes exemplary weight elements 540 positioned such that the aquatic toy 500 may be maintained in a relatively vertical position in water.

As further illustrated in FIG. 5, the aquatic toy 500 also includes a first additional fabric portion 516 and a second additional fabric portion 518. The first additional fabric portion 516 extends substantially downward from an upper portion of the hollow opening 514, while the second additional fabric portion 518 extends substantially upward from a lower portion of the hollow opening 514.

It should be appreciated that the fabric portion 510, the first additional fabric portion 516, and/or the second additional fabric portion 518 may be weighted and/or buoyed using any of the materials or methods described or referenced herein. It should also be appreciated that other additional fabric portions may be added to the aquatic toy 500.

Figure 6:
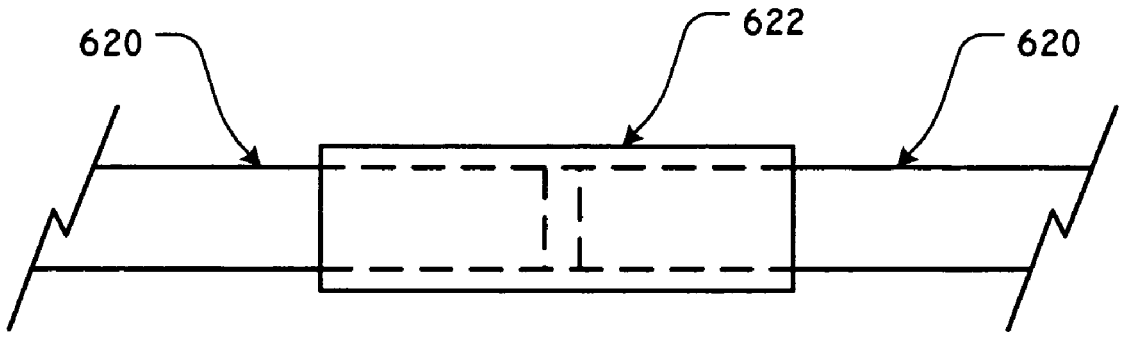
FIG. 6 shows a first exemplary embodiment of a method for joining the frame member as used in one exemplary embodiment of the present invention.

FIG. 6 shows a first exemplary embodiment of a method for joining a frame member as used in one exemplary embodiment of the present invention. As shown in FIG. 6, the frame member 620 comprises at least one strip or segment of material connected to form a continuous loop. It should be understood that the frame member 620 may comprise any of the frame members 120, 220, 320, 420, or 520, as described above, with reference to FIGS. 1–5.

As shown in FIG. 6, the at least one strip or segment of the frame member 620 is joined by a frame member joining means 622, such as, for example, a sleeve, for joining the ends of the at least one strip or segment. As shown in FIG. 6, the ends of the at least one strip or segment of the frame member 620 within the joining means 622 are shown in dashed lines for clarification.

In various exemplary embodiments, the joining means 622 is a sleeve with an outer diameter not substantially greater than an outer diameter of the frame member 620 and an inner diameter that is equal to or slightly smaller than the outer diameter of the frame member 620. In this manner, when ends of a segment of the frame member 620 are inserted into the joining means 622, they are able to be frictionally maintained within the joining means 622.

In various exemplary embodiments, the inner diameter of the joining means 622 is substantially similar to or larger than an outer diameter of the frame member 620 and the end of the at least one segment of the frame member 620 must be mechanically fastened, joined, stitched, fused, glued, welded, or otherwise attached or adhered within the joining means 622.

It should be appreciated that in various exemplary embodiments, the frame member 620 is a continuous loop or band of material and a joining means 622 is not required. Alternatively, opposing ends of the at least one strip or segment of the frame member 620 may be mechanically fastened, joined, stitched, fused, glued, welded, or otherwise attached or adhered together such that the joining means 622 is not necessary.

Figure 7:
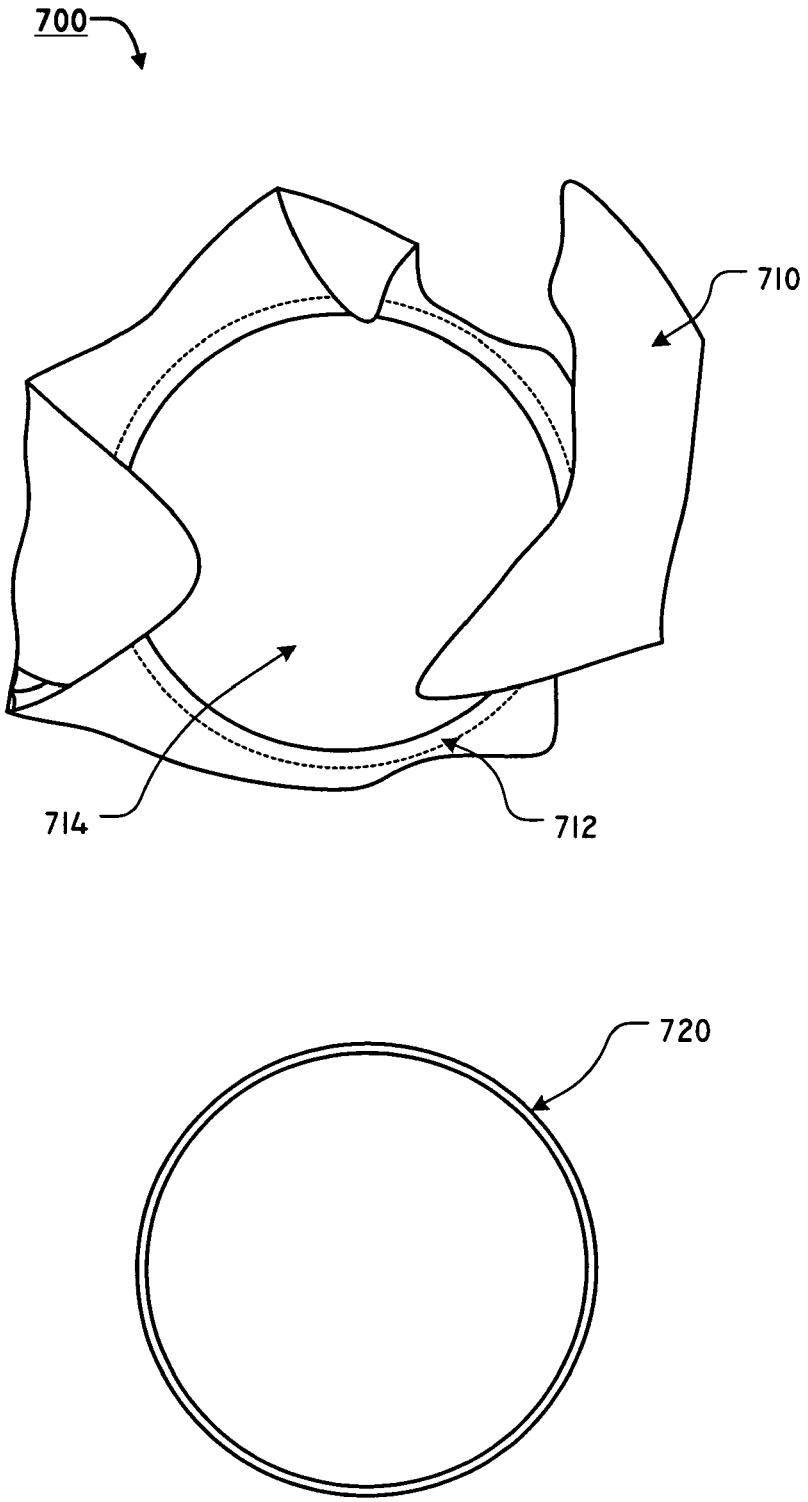
FIG. 7 shows an exemplary embodiment of an aquatic toy with the frame member removed such that the aquatic toy may be folded or collapsed according to this invention.

FIG. 7 shows an exemplary embodiment of an aquatic toy with the frame member removed such that the aquatic toy may be folded or collapsed according to this invention. As shown in FIG. 7, the aquatic toy 700 includes at least some of a fabric portion 710, a frame pocket 712, a hollow opening 714, a frame member 720, at least one optional buoyancy element 730 (not shown), and at least one optional weight element 740 (not shown).

It should be understood that each of these elements corresponds to and operates similarly to the fabric portion 410, the frame pocket 412, the hollow opening 414, the frame member 420, the at least one optional buoyancy element 430, and the at least one optional weight element 440, as described above with reference to FIG. 4. It should also be understood that the aquatic toy 700 may include any of the features and/or embodiments of the aquatic toy, as described above with respect to FIGS. 1–6.

When the frame member is removed from the aquatic toy, the fabric portion 710 of the aquatic toy 700 may be folded or collapsed.

While this invention has been described in conjunction with the exemplary embodiments outlined above, it is evident that many alternatives, modifications, and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. An apparatus, comprising:

a frame member forming a closed loop and defining an interior area within the closed loop and an exterior area outside the closed loop, the frame member at least partially defining an opening within the interior area;

a fabric portion coupled to the frame member, the fabric portion positioned substantially within a portion of the exterior area;

at least one buoyancy member disposed at a location on the fabric portion; and at least one weight disposed at a location on the fabric portion, the fabric portion extending outwardly from the frame member away from the opening and maintaining a substantially planar orientation when submerged in water.

2. The apparatus of claim 1, wherein the fabric portion includes at least two different types of material.

3. The apparatus of claim 1, wherein the fabric portion is configured to contact a bottom surface of a body of water while the frame member is positioned at a distance spaced above the bottom surface of the body of water.

4. The apparatus of claim 1, wherein the frame member is configured to be removably coupled to the fabric portion.

5. The apparatus of claim 1, wherein the frame member includes a corrosion resistant material.

6. The apparatus of claim 1, wherein the frame member includes multiple frame segments.

7. The apparatus of claim 1, wherein the fabric portion includes a pocket formed substantially around the perimeter of the opening, the frame member is positioned at least partially within the pocket.

8. An apparatus, comprising:

a first fabric portion including an interior portion and an exterior portion, the interior portion at least partially defining an opening and the exterior portion disposed opposite from the opening;

a second fabric portion coupled to at least one of the first fabric portion or the frame member, the second fabric portion extending substantially within the opening, the second fabric portion having an area less than an area of the opening;

a frame member coupled to the interior portion of the fabric portion and disposed between the opening and the exterior portion of the fabric portion, the frame member forming a substantially rigid perimeter of the opening;

at least one weight coupled to the exterior portion of the fabric portion; and at least one buoyancy member coupled to the exterior portion of the fabric portion.

9. The apparatus of claim 8, wherein the at least one buoyancy member and the at least one weight are disposed at locations on the exterior portion of the fabric portion, the fabric portion maintains a substantially planar orientation when submerged in water.

10. The apparatus of claim 8, wherein the frame member forms a closed loop.

11. The apparatus of claim 8, wherein the fabric portion includes a frame pocket, the frame member is disposed within the frame pocket.

12. The apparatus of claim 8, the fabric portion being a first fabric portion, the apparatus further including a second fabric portion coupled to the first fabric portion, and one of a weight and a buoyancy member is coupled to the second fabric portion.

13. The apparatus of claim 8, wherein the frame member includes a plurality of frame segments.

14. The apparatus of claim 8, wherein the frame member is at least partially constructed of a corrosion resistant material.

* * * * *